US011414941B2

(12) United States Patent
Romer et al.

(10) Patent No.: US 11,414,941 B2
(45) Date of Patent: Aug. 16, 2022

(54) LOCK MANDREL WITH SPRING-LOADED LOCKING COLLAR

(71) Applicant: ExxonMobil Upstream Research Company, Spring, TX (US)

(72) Inventors: Michael C. Romer, The Woodlands, TX (US); Santos Ortiz, Houston, TX (US); George King, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 31 days.

(21) Appl. No.: 17/197,385

(22) Filed: Mar. 10, 2021

(65) Prior Publication Data

US 2021/0317716 A1 Oct. 14, 2021

Related U.S. Application Data

(60) Provisional application No. 63/009,086, filed on Apr. 13, 2020.

(51) Int. Cl.

| | |
|---|---|
| ***E21B 23/03*** | (2006.01) |
| ***E21B 4/06*** | (2006.01) |
| ***E21B 23/01*** | (2006.01) |
| ***E21B 23/02*** | (2006.01) |
| ***E21B 43/12*** | (2006.01) |

(52) U.S. Cl.

CPC ..... *E21B 23/03* (2013.01); *E21B 4/06* (2013.01); *E21B 23/01* (2013.01); *E21B 23/02* (2013.01); *E21B 43/128* (2013.01)

(58) Field of Classification Search

CPC . E21B 23/03; E21B 4/06; E21B 23/01; E21B 23/02; E21B 43/128

See application file for complete search history.

(56) References Cited

U.S. PATENT DOCUMENTS

| | | | | |
|---|---|---|---|---|
| 3,208,531 | A | 9/1965 | Tamplen | |
| 4,425,965 | A | 1/1984 | Russell et al. | |
| 4,745,974 | A * | 5/1988 | Higgins | E21B 34/105 166/217 |
| 5,390,735 | A | 2/1995 | Williamson, Jr. | |
| 8,079,417 | B2 * | 12/2011 | Wegener | E21B 23/01 166/62 |
| 10,711,549 | B2 * | 7/2020 | Courville | E21B 31/107 |
| 2016/0290061 | A1 * | 10/2016 | Perkins | E21B 17/028 |
| 2018/0066487 | A1 | 3/2018 | Courville | |

* cited by examiner

*Primary Examiner* — Jonathan Malikasim
(74) *Attorney, Agent, or Firm* — Leandro Archederra, III

(57) ABSTRACT

A lock mandrel is described herein. The lock mandrel includes an upper connector and a lower connector. The upper connector includes locking keys configured to attach the lock mandrel to a landing nipple on a tubing within a hydrocarbon well. The upper connector also includes a spring-loaded locking collar configured to prevent the locking keys from disengaging from the landing nipple by pressing radially against the locking keys from the inside when in a seated position, and allow the locking keys to disengage from the landing nipple by retracting away from the locking keys when in an unseated position. The lower connector includes a tool adaptor configured to attach a downhole tool to the lock mandrel.

22 Claims, 9 Drawing Sheets

102

102

102

102

102

102

600

LOCK MANDREL WITH SPRING-LOADED LOCKING COLLAR

CROSS-REFERENCE TO RELATED APPLICATIONS

This application claims the benefit of U.S. Provisional Application 63/009,086, filed Apr. 13, 2020, the disclosure of which is hereby incorporated by reference in its entirety.

FIELD OF THE INVENTION

The techniques described herein relate to the field of well completions and downhole operations. More particularly, the techniques described herein relate to a lock mandrel with a spring-loaded locking collar for securing a tool, such as a downhole pump, to a landing nipple within a hydrocarbon well.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

During the drilling of a well, large diameter wellbores are cased, leading to narrow diameter wellbores which are also cased, finally leading to the production zone in the reservoir. As each section is cased, concrete is injected around the casing to hold it in place. The well is then completed by operations to begin the production of hydrocarbon fluids from the reservoir. The completion operations include the formation of perforations through the casing and concrete of the final section into the reservoir using perforating guns. Tubing is then inserted down the wellbore into the production zone.

After completion, many hydrocarbon wells initially have sufficient reservoir pressure to force hydrocarbon fluids from the reservoir to the surface. Particularly, in the case of gas wells, the reservoir pressure is often high enough to force both gas and liquids, such as condensate, oil, and water, to the surface. However, as gas production continues, the reservoir pressure declines. As the reservoir pressure declines, the velocity of the fluid in the tubing decreases. Eventually, the gas velocity within the tubing is no longer sufficient to lift liquid droplets to the surface. Therefore, liquids begin to accumulate in the tubing. Such liquid accumulation increases the pressure that the wellbore exerts on the producing reservoir, which is commonly referred to as "back pressure." The increase in back pressure inhibits the flow of gas within the tubing and, thus, limits the ultimate recovery of gas from the reservoir.

Therefore, it is desirable to remove accumulated liquids from the wellbore on a continual basis. At different stages in the life of a gas well, various techniques can be employed to move accumulated liquids to the surface. Such techniques include injecting foaming agents or surfactants into the wellbore, installing velocity tubing or an artificial lift system within the wellbore, and/or utilizing downhole pumps to force liquids to the surface. In many cases, the proper application of pumps, in particular, can lower the abandonment pressure of a well, which is the minimum bottomhole pressure at which a company can make an economic profit on the well.

Specialized pumps, such as micro positive displacement pumps and solid state pumps, have been developed for downhole applications. A downhole pump is often deployed using a commercially-available wireline that is capable of transmitting about 2,500 watts or more of electricity to an AC or DC motor, or a solid state device, powering the unit. In many cases, the downhole pump is landed on a landing nipple at a desired location along the tubing. A lock mandrel attached to the downhole pump is then used to secure the downhole pump to the landing nipple. The combination of the lock mandrel and the landing nipple maintains the downhole pump at the desired location along the tubing and prevents the downhole pump from falling below the tubing. The lock mandrel and the landing nipple also enable a seal between the downhole pump and the tubing, separating the pump's intake from its discharge and allowing fluids to be pumped to the surface.

The lock mandrel is typically secured to the landing nipple via a set of locking keys on the lock mandrel that correspond to the particular nipple profile of the landing nipple. The locking keys are designed to latch into the landing nipple and be held in place using key springs. However, in some cases, the high discharge pressure of the downhole pump creates a large pressure differential between the pump's intake and discharge during operation. This large pressure differential may cause the downhole pump to create enough downward force to compress the key springs, allowing the locking keys on the lock mandrel to become unseated from the landing nipple. As a result, the downhole pump may move out of position and quit working effectively. This problem could be resolved by using a "no-go" landing nipple, which includes a reduced-diameter shoulder that would prevent the downhole pump from moving in a downward direction. However, it is not always feasible to use no-go landing nipples for downhole pumps, since full-diameter pumping accessories, such as standing valves, gas separators, solids control devices, and the like, are commonly installed below such pumps. Also, reduced diameter constrictions along wellbore fluid flowpaths can create a pressure drop across the constriction, resulting in dissolved gas coming out of solution, entering the pump, and reducing pumping efficiency. Therefore, there is a need for an improved lock mandrel that is capable of maintaining a downhole pump, or other similar downhole tool, in the proper location during operation without requiring a reduced-diameter shoulder that prevents the installation of full-diameter pumping accessories.

SUMMARY OF THE INVENTION

An embodiment described herein provides a lock mandrel. The lock mandrel includes an upper connector and a lower connector. The upper connector includes locking keys configured to attach the lock mandrel to a landing nipple on a tubing within a hydrocarbon well. The upper connector also includes a spring-loaded locking collar configured to prevent the locking keys from disengaging from the landing nipple by pressing radially against the locking keys from the inside when in a seated position, and allow the locking keys to disengage from the landing nipple by retracting away from the locking keys when in an unseated position. The lower connector includes a tool adaptor configured to attach a downhole tool to the lock mandrel.

In various embodiments, the upper connector includes a compression spring configured to prevent the spring-loaded locking collar from retracting to the unseated position in response to an increase in a pressure differential within the lock mandrel and allow the spring-loaded locking collar to retract to the unseated position in response to a force applied from a surface. In addition, in various embodiments, the lower connector further includes a number of seal bores positioned on an equalizing port, and the upper connector further includes a number of equalizing pins configured to engage with the seal bores on the equalizing port when the spring-loaded locking collar is in the seated position and disengage from the seal bores when the spring-loaded locking collar is in the unseated position, equalizing a hydrostatic pressure across the lock mandrel. Each equalizing pin may include an alignment head configured to self-align the equalizing pin as it slides into a corresponding seal bore, and a sealing ring that fluidically seals the corresponding seal bore when the equalizing pin is engaged with the corresponding seal bore.

In various embodiments, the upper connector also includes a number of slots and a number of screws that are configured to provide a jarring force to aid in detaching the lock mandrel from the landing nipple when the spring-loaded locking collar is in the unseated position. The slots may be positioned along an outer diameter of the upper connector, and the screws may be attached to a jarring rod that is attached to a compression spring corresponding to the spring-loaded locking collar.

In some embodiments, the downhole tool includes a downhole pump. The downhole pump may include a micro positive displacement pump.

In various embodiments, the upper connector further includes a hollow inner rod and a hollow outer rod that is slidably positioned around the hollow inner rod, and the spring-loaded locking collar and a corresponding compression spring are positioned along an outer diameter of the hollow outer rod. In various embodiments, the locking keys correspond to an X nipple profile. Moreover, in some embodiments, the lock mandrel further includes an electronic chassis and an electronic chassis housing that is attached to the upper connector of the lock mandrel. Furthermore, in some embodiments, the lock mandrel includes a cable head configured to attach the lock mandrel to a wireline, while, in other embodiments, the lock mandrel includes an external fishing neck for attaching a wireline to the lock mandrel.

Another embodiment described herein provides a method for securing a downhole tool within a hydrocarbon well using a lock mandrel with a spring-loaded locking collar. The method includes providing a lock mandrel with a spring-loaded locking collar, wherein the lock mandrel is attached to a downhole tool to be deployed inside a hydrocarbon well. The method also includes running the lock mandrel into a tubing of the hydrocarbon well using a wireline. The method further includes landing the lock mandrel on a landing nipple within the tubing such that locking keys on the lock mandrel attach to the landing nipple and the spring-loaded locking collar within the lock mandrel moves to a seated position. The spring-loaded locking collar is configured to prevent the locking keys from disengaging from the landing nipple by pressing radially against the locking keys from the inside when in the seated position.

In various embodiments, the method also includes applying a force from a surface via the wireline such that the spring-loaded locking collar moves to an unseated position, wherein the spring-loaded locking collar is configured to allow the locking keys to disengage from the landing nipple by retracting away from the locking keys when in the unseated position. The method may also include pulling the lock mandrel and the attached downhole tool out of the tubing of the hydrocarbon well. Moreover, in some embodiments, landing the lock mandrel on the landing nipple causes a number of equalizing pins within the lock mandrel to seal a flow path through the lock mandrel, and applying the force from the surface causes the equalizing pins to unseal the flow path, allowing a hydrostatic pressure across the lock mandrel to equalize. Furthermore, in some embodiments, applying the force from the surface causes a number of slots and a number of screws within the lock mandrel to provide a jarring force that aids in detaching the lock mandrel from the landing nipple.

In various embodiments, the method also includes operating the downhole tool within the hydrocarbon well. In some embodiments, the downhole tool includes a downhole pump, and operating the downhole pump includes using the downhole pump to remove at least a portion of a wellbore liquid from the tubing of the hydrocarbon well.

Another embodiment described herein provides a tool assembly. The tool assembly includes a lock mandrel and a downhole pump. The lock mandrel includes an upper connector and a lower connector. The upper connector includes locking keys configured to attach the lock mandrel to a landing nipple on a tubing within a hydrocarbon well. The upper connector also includes a spring-loaded locking collar configured to prevent the locking keys from disengaging from the landing nipple by pressing radially against the locking keys from the inside when in a seated position, and allow the locking keys to disengage from the landing nipple by retracting away from the locking keys when in an unseated position. The lower connector includes a pump adaptor configured to attach the downhole pump to the lock mandrel. The downhole pump is configured to remove at least a portion of a wellbore liquid from the tubing of the hydrocarbon well.

In various embodiments, the lower connector includes an equalizing port with a number of seal bores, and the upper connector includes a number of equalizing pins. The equalizing pins are configured to engage with the seal bores on the equalizing port when the spring-loaded locking collar is in the seated position, and disengage from the seal bores when the spring-loaded locking collar is in the unseated position, equalizing a hydrostatic pressure across the lock mandrel. In some embodiments, each equalizing pin includes an alignment head configured to self-align the equalizing pin as it slides into a corresponding seal bore and a sealing ring that fluidically seals the corresponding seal bore when the equalizing pin is engaged with the corresponding seal bore.

In various embodiments, the upper connector of the lock assembly further includes a compression spring configured to prevent the spring-loaded locking collar from retracting to the unseated position in response to an increase in a pressure differential within the lock mandrel. The compression springs is also configured to allow the spring-loaded locking collar to retract to the unseated position in response to a force applied from a surface.

In various embodiments, the upper connector of the lock assembly also includes a number of slots and a number of screws that are configured to provide a jarring force to aid in detaching the lock mandrel from the landing nipple when the spring-loaded locking collar is in the unseated position. The slots may be positioned along an outer diameter of the upper connector, and the screws may be attached to a jarring rod that is attached to a compression spring corresponding to the spring-loaded locking collar.

In some embodiments, the downhole pump is a micro positive displacement pump. In addition, in some embodiments, the upper connector of the lock mandrel further includes a hollow inner rod and a hollow outer rod that is slidably positioned around the hollow inner rod, and the spring-loaded locking collar and a corresponding compression spring are positioned along an outer diameter of the hollow outer rod. Further, in some embodiments, the locking keys on the upper connector of the lock mandrel correspond to an X nipple profile.

In some embodiments, the lock mandrel also includes an electronic chassis and an electronic chassis housing that is attached to the upper connector of the lock mandrel. Further, in some embodiments, the lock mandrel includes a cable head configured to attach the lock mandrel to a wireline, while, in other embodiments, the lock mandrel includes an external fishing neck for attaching a wireline to the lock mandrel.

DESCRIPTION OF THE DRAWINGS

The foregoing and other advantages of the present techniques may become apparent upon reviewing the following detailed description and drawings of non-limiting examples in which.

Figure 1:
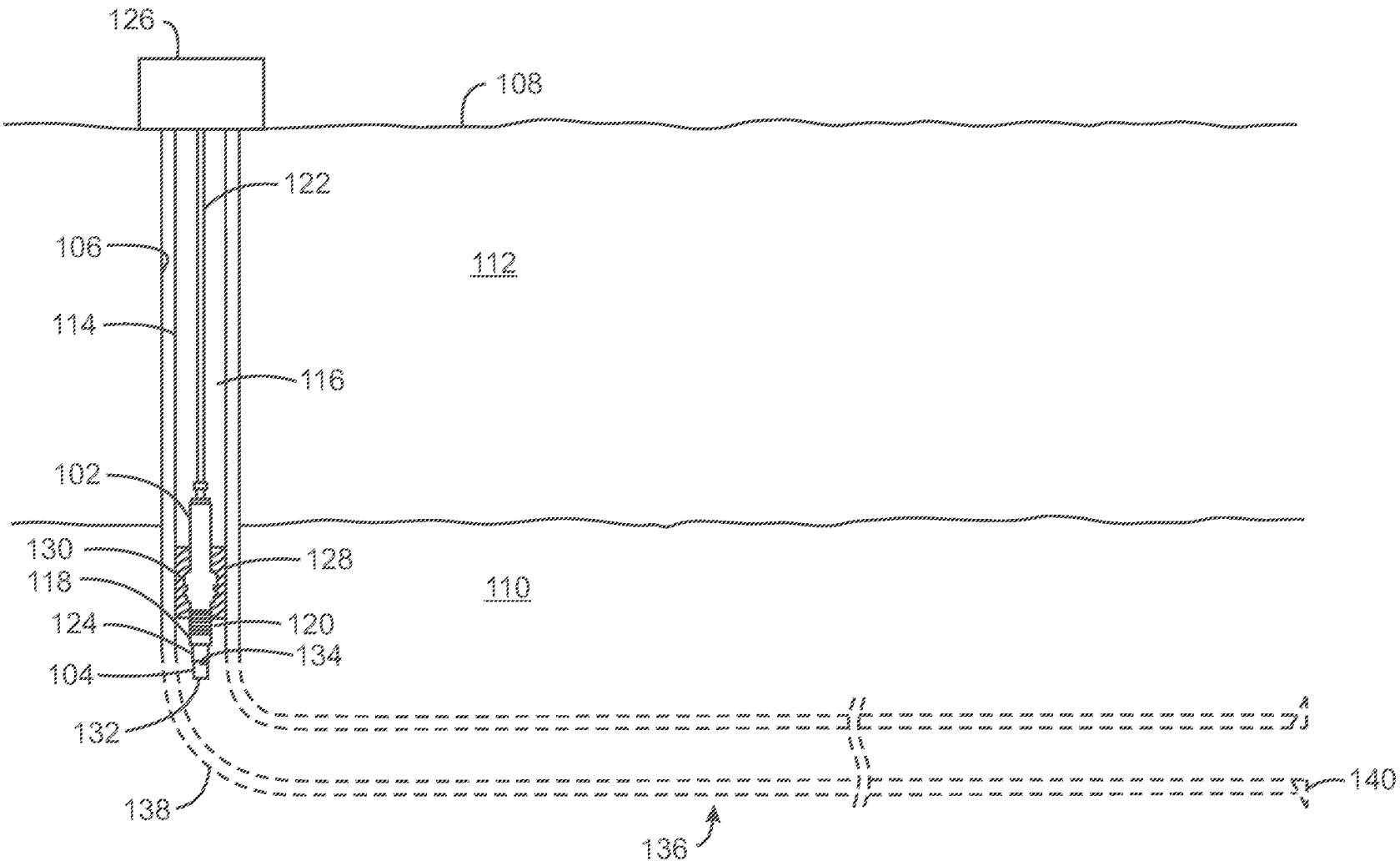
FIG. 1 is a schematic view of a hydrocarbon well that may utilize a lock mandrel with an internal spring-loaded locking collar to secure a downhole pump within the hydrocarbon well.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "completion" refers to a group of equipment and operations that may be installed and performed to produce hydrocarbons from a subsurface reservoir using a well. The completion may include the casing, liner, tubing, cement, completion fluid, artificial lift equipment, and other equipment used to prepare the well to produce hydrocarbons. Moreover, the term "completion operations" refers generally to the operations used to prepare the well for hydrocarbon production.

As used herein, the term "configured" mean that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

As used herein, the term "landing nipple" refers to a wellbore completion component fabricated as a short section of heavy-wall tubular with a machined internal surface that provides a seal area and a locking profile, referred to herein as a "nipple profile." A "lock mandrel" is typically run into the wellbore via wireline or slickline, and is mated to the landing nipple to provide a setting point for a downhole tool that is attached to the lock mandrel. Landing nipples are included in most completions at predetermined intervals to enable the installation of tools, such as pumps and flow-control devices, within the tubing string. Two of the most commonly-used types of landing nipples are no-go landing nipples and selective landing nipples. A "no-go landing nipple" is a landing nipple that incorporates a reduced-diameter shoulder, or nipple profile, that prevents a tool from passing through the landing nipple. In many completions, a no-go landing nipple is preferred for the deepest nipple location, providing a no-go barrier to prevent a tool assembly from dropping below the tubing string. A "selective landing nipple" is a landing nipple that includes a particular nipple profile design that selectively mates with a corresponding lock mandrel. Two common types of selective nipple profiles are the "X nipple profile" and the "R nipple profile." Moreover, two types of selective no-go nipple profiles are the "XN nipple profile" and the "XR nipple profile."

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing, tubing, and other equipment that is located inside the wellbore. Moreover, according to embodiments described herein, the terms "downhole" and "subsurface" are sometimes used interchangeably, although the term "downhole" is generally used to refer specifically to the inside of the wellbore.

The terms "well" and "wellbore" refer to holes drilled vertically, at least in part, and may also refer to holes drilled with deviated, highly deviated, and/or horizontal sections. The term also includes wellhead equipment, surface casing, intermediate casing, and the like, typically associated with oil and gas wells.

The present techniques relate to a lock mandrel with an internal spring-loaded locking collar for securing a downhole tool, such as a downhole pump, to a landing nipple within the tubing of a hydrocarbon well. The lock mandrel includes locking keys that correspond to a nipple profile of the landing nipple. The locking keys are configured to attach the lock mandrel to the landing nipple, thus securing the downhole tool within the hydrocarbon well. However, some downhole tools, such as downhole pumps, in particular, can create a large enough pressure differential to cause disengagement of the locking keys from the landing nipple during normal operation. Therefore, the spring-loaded locking collar is designed to prevent this by pressing radially against the locking keys from the inside and preventing the locking keys from retracting in response to an increase in the pressure differential across the lock mandrel. Moreover, the spring-loaded locking collar is configured to easily retract to allow the lock mandrel to be pulled out of the tubing in response to a force applied from the surface.

In various embodiments, the lock mandrel also includes equalizing pins that are configured to reduce the amount of force required to disengage the lock mandrel from the landing nipple. In addition, in various embodiments, the lock mandrel includes set screws and slots that provide a jarring force to aid in the disengagement of the lock mandrel from the landing nipple.

Hydrocarbon Well Utilizing a Lock Mandrel with a Spring-Loaded Locking Collar

FIG. 1 is a schematic view of a hydrocarbon well 100 that may utilize a lock mandrel 102 with an internal spring-loaded locking collar to secure a downhole pump 104 within the hydrocarbon well 100. The hydrocarbon well 100 includes a wellbore 106 that extends between a surface 108 and a reservoir 110 that is present within a subsurface formation 112. The hydrocarbon well 100 also includes a string of tubing 114 that extends within the wellbore 106 and defines a tubing conduit 116. In some embodiments, the hydrocarbon well 100 is a gas well. Moreover, in various embodiments, the hydrocarbon well 100 includes accumulated wellbore liquid, such as condensate, oil, and water, within the tubing conduit 116.

In various embodiments, the downhole pump 104 is a micro positive displacement pump that is configured to generate a pressurized wellbore liquid from the accumulated wellbore liquid. Specifically, the downhole pump 104 may increase the pressure of the accumulated wellbore liquid such that it has a sufficient pressure to permit a volume of the pressurized wellbore liquid to be conveyed to the surface 108 and, thus, removed from the hydrocarbon well 100. In various embodiments, the lock mandrel 102 includes a pump adaptor 118 and a seal stack 120 that fluidically seals the connection between the pump adaptor 118 and the rest of the lock mandrel 102. The pump adaptor 118 secures the downhole pump 104 to the lock mandrel 102. Moreover, the combination of the downhole pump 104 and the lock mandrel 102 forms a tool assembly that may be deployed into the hydrocarbon well 100 using a wireline 122, such as a commercially-available wireline that is capable of transmitting about 2,500 watts or more of electricity to a power source 124, such as an AC or DC motor, that powers the downhole pump 104. In various embodiments, the wireline 122 delivers electricity to the power source 124 from an AC or DC generator, for example, located at (or near) a wellhead 126 of the hydrocarbon well 100.

In some embodiments, the wellhead 126 couples the hydrocarbon well 100 to other equipment, such as equipment for running the wireline 122 into the hydrocarbon well 100. Such equipment may include a wireline unit or a lubricator (not shown), which may extend as much as 75 feet above the wellhead 126. In this respect, the lubricator must be of a length greater than the length of the tool assembly attached to the wireline 122 to ensure that the tool assembly may be safely deployed into the hydrocarbon well 100 and then removed from the hydrocarbon well 100 under pressure.

According to embodiments described herein, the downhole pump 104 is landed on a landing nipple 128, such as a selective landing nipple including an X nipple profile, for example, within the tubing 114. In some embodiments, the tubing 114 includes a number of landing nipples 128, and the downhole pump 104 is landed on the landing nipple 128 that is located at a desired depth or zone within the hydrocarbon well 100. The lock mandrel 102 attached to the downhole pump 104 is then used to attach the downhole pump 104 to the landing nipple 128. Specifically, the lock mandrel 102 includes a set of locking keys 130 that correspond to the particular nipple profile of the landing nipple 128. The locking keys 130 are designed to latch into the landing nipple 128 and be held in place using key springs (not shown). The engagement of the locking keys 130 with the landing nipple 128 maintains the lock mandrel 102 and, thus, the attached downhole pump 104, at the desired location along the tubing 114. Moreover, the combination of the lock mandrel 102 and the landing nipple 128 enables a seal between the downhole pump 104 and the tubing 114.

The downhole pump 104 includes a fluid intake 132 for receiving the wellbore liquid from within the portion of the tubing conduit 116 extending below the downhole pump 104, as well as a fluid discharge 134 for flowing the resulting pressurized wellbore liquid into the portion of the tubing conduit 116 extending between the downhole pump 104 and the surface 108. Moreover, the portion of the tubing conduit 116 extending between the downhole pump 104 and the surface 108 may function as a liquid discharge conduit for conveying the pressurized wellbore liquid to the surface 108.

In some embodiments, the hydrocarbon well 100 includes one or more deviated regions, such as the horizontal region 136 indicated by the dashed lines in FIG. 1. Moreover, in some embodiments, the downhole pump 104 is positioned within the horizontal region 136 (or other deviated region) within the hydrocarbon well 100, such as between a heel 138 and a toe 140 of the horizontal region 136. In such embodiments, one or more landing nipples 128 may additionally or alternatively be located within the horizontal region 136, and the lock mandrel 102 that is attached to the downhole pump 104 may be designed such that it correlates to the landing nipple 128 at the desired location within the hydrocarbon well 100.

In various embodiments, the downhole pump 104 has a high discharge pressure, which creates a large pressure differential between the fluid intake 132 and the fluid discharge 134 of the downhole pump 104. For example, the pressure differential may be at least 2,000 psi, at least 4,000 psi, at most 8,000 psi, and/or at most 6,000 psi. In operation, this large pressure differential may cause the downhole pump 104 to create enough downward force to cause traditional lock mandrels to become unseated from the landing nipple 128. Therefore, the lock mandrel 102 described herein includes a spring-loaded locking collar (not shown) that prevents the locking keys 130 on the lock mandrel 102 from becoming unseated from the landing nipple 128, as described further herein.

The cross-sectional schematic view of FIG. 1 is not intended to indicate that the hydrocarbon well 100 is to include all of the components shown in FIG. 1, or that the hydrocarbon well 100 is limited to only the components shown in FIG. 1. Rather, any number of components may be omitted from the hydrocarbon well 100 or added to the hydrocarbon well 100, depending on the details of the specific implementation. Moreover, while embodiments described herein focus on the use of the lock mandrel 102 for securing the downhole pump 104 within the hydrocarbon well 100, it is to be understood that the lock mandrel 102 may be used to secure any downhole tool within the hydrocarbon well 100, particularly any downhole tool which is likely to generate a large pressure differential and/or enough force to compromise the tool's attachment to the landing nipple 128 within the hydrocarbon well 100.

In some embodiments, the hydrocarbon well 100 also includes a well screen or filter assembly for filtering sand and other particles out of the wellbore liquid before it enters the fluid intake 132 of the downhole pump 104. In such embodiments, the hydrocarbon well 100 may also include a standing valve or velocity fuse that is positioned between the outlet of the well screen or filter assembly and the fluid intake 132 of the downhole pump 104. The standing valve or velocity fuse may be configured to back-flush the well screen or filter assembly and to maintain a column of wellbore liquid within the tubing 114 for well control purposes. Moreover, in some embodiments, the well screen or filter is configured to seat on a second landing nipple with a no-go nipple profile that is located upstream of the downhole pump 104, i.e., below the fluid intake 132 of the downhole pump 104.

Lock Mandrel with a Spring-Loaded Locking Collar

Figure 2:
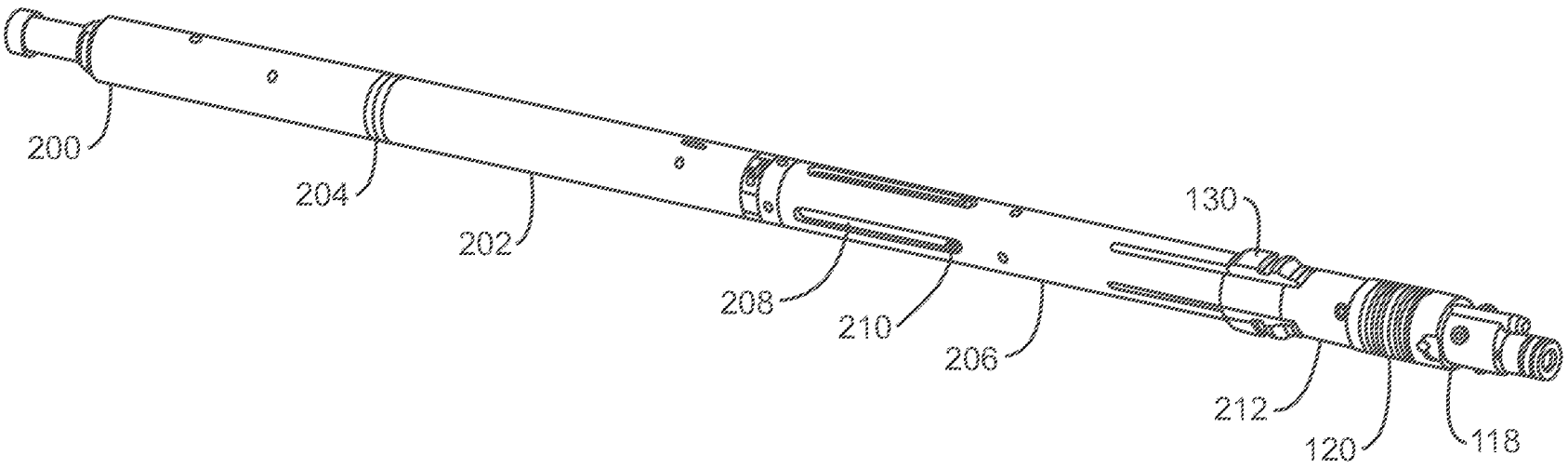
FIG. 2 is a perspective view of an exemplary embodiment of the lock mandrel described herein.

FIG. 2 is a perspective view of an exemplary embodiment of the lock mandrel 102 described herein. Like numbered items are as described with respect to FIG. 1. The lock mandrel 102 includes a cable head 200, which is an electromechanical device that connects the lock mandrel 102 to the wireline 122. Specifically, the cable head 200 provides an attachment to mechanical armor wires (not shown) within the wireline 122, which give the wireline 122 its strength. The cable head 200 also provides an attachment to an electronic chassis housing 202 of the lock mandrel 102, usually by means of a threaded connection 204. This attachment to the electronic chassis housing 202 provides a good electrical path from the electrical conductors of the wireline 122 to the electrical contacts of the electronic chassis included within the electronic chassis housing 202, and shields this electrical path from contact with conductive fluids, such as certain drilling muds. In addition, the cable head 200 may include a "weak point." This ensures that, if the lock mandrel 102 and the attached downhole pump 104 become irretrievably stuck in the hydrocarbon well 100, the operator may intentionally pull in excess of the breaking strength of the "weak point" on the cable head 200, causing the wireline 122 to pull out of the cable head 200 in a controlled fashion.

The electronic chassis housing 202 of the lock mandrel 102 provides an attachment to an upper connector 206 of the lock mandrel 102. The upper connector 206 includes the locking keys 130 that are configured to attach the lock mandrel 102 to the landing nipple 128 on the tubing 114 within the hydrocarbon well 100. According to the embodiment shown in FIG. 2, the locking keys 130 on the upper connector 206 are designed to mate with a landing nipple including an X nipple profile. However, the locking keys 130 may also be designed to mate with any other suitable type of nipple profile, such as an R nipple profile, for example.

The upper connector 206 also includes an internal spring-loaded locking collar (not shown) that presses radially against the locking keys 130 from the inside when in the seated position, thus preventing the lock mandrel 102 from becoming unseated when there is a large pressure differential across the downhole pump 104 during operation. The upper connector 206 also includes two (or more) equalizing pins (not shown) that are used to reduce the amount of force required to pull the lock mandrel 102 out of the tubing 114. Further, the upper connector 206 includes a number of slots 208 and screws 210 that can be used to jar the lock mandrel 102 to help detach it from the landing nipple 128 during unseating.

The upper connector 206 of the lock mandrel 102 provides an attachment to a lower connector 212 of the lock mandrel 102. The lower connector 212 includes the seal stack 120 and the pump adaptor 118 for attaching the downhole pump 104 to the lock mandrel 102. In addition, the lower connector 212 includes an internal equalizing port (not shown) including seal bores that correspond to the equalizing pins. As described further herein, the equalizing pins enter the seal bores during seating of the lock mandrel 102, and are pulled out of the seal bores during unseating of the lock mandrel 102 to allow for equalization of the hydrostatic pressure within the lock mandrel 102.

Figure 3A:
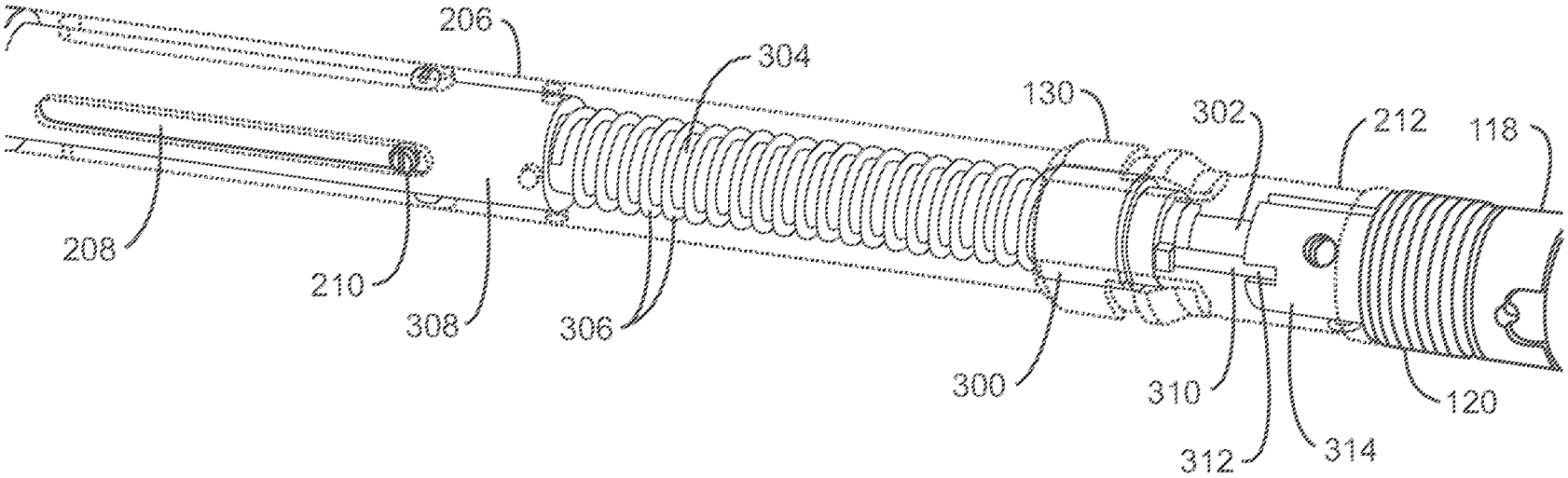
FIG. 3A is a perspective view of an exemplary embodiment of the lock mandrel showing the internal spring-loaded locking collar in the seated position.

FIG. 3A is a perspective view of an exemplary embodiment of the lock mandrel 102 showing the internal spring-loaded locking collar 300 in the seated position. Like numbered items are as described with respect to FIGS. 1 and 2. The upper connector 206 of the lock mandrel 102 includes a hollow inner rod 302 and a hollow outer rod 304 that is slidably positioned around the hollow inner rod 302. The spring-loaded locking collar 300 is positioned on one end of the hollow outer rod 304, and is attached to a corresponding compression spring 306 that winds around the hollow outer rod 304. Specifically, the compression spring 306 is positioned between the spring-loaded locking collar 300 and a jarring rod 308 that is slidably positioned around the opposite end of the hollow outer rod 304 within the upper connector 206.

When the spring-loaded locking collar 300 is in the seated position, as shown in FIG. 3A, the spring-loaded locking collar 300 rests against the locking keys 130 on the outer diameter of the upper connector 206, pressing radially on the locking keys 130 from the inside and preventing the locking keys 130 from retracting in response to force applied by the downhole pump 104 during operation. Moreover, the compression spring 306 provides pressure resistance for the spring-loaded locking collar 300, preventing it from being easily unseated in response to an increase in the pressure differential within the lock mandrel 102.

In addition, two equalizing pins 310 extend from the hollow outer rod 304 in proximity to the spring-loaded locking collar 300. The equalizing pins 310 are configured to engage with corresponding seal bores 312 on the equalizing port 314 within the lower connector 212 when the spring-loaded locking collar 300 is in the seated position. This helps to provide a complete seal between the lock mandrel 102 and the landing nipple 128 within the hydrocarbon well 100.

Furthermore, as shown in FIG. 3A, the screws 210 are attached to the outer diameter of the jarring rod 308. The screws 210 rest in an unengaged position within the slots 208 when the spring-loaded locking collar 300 is in the seated position. However, movement of the jarring rod 308 during unseating of the spring-loaded locking collar 300 causes the screws 210 to move to an engaged position within the slots 208, as described further with respect to FIG. 3B.

Figure 3B:
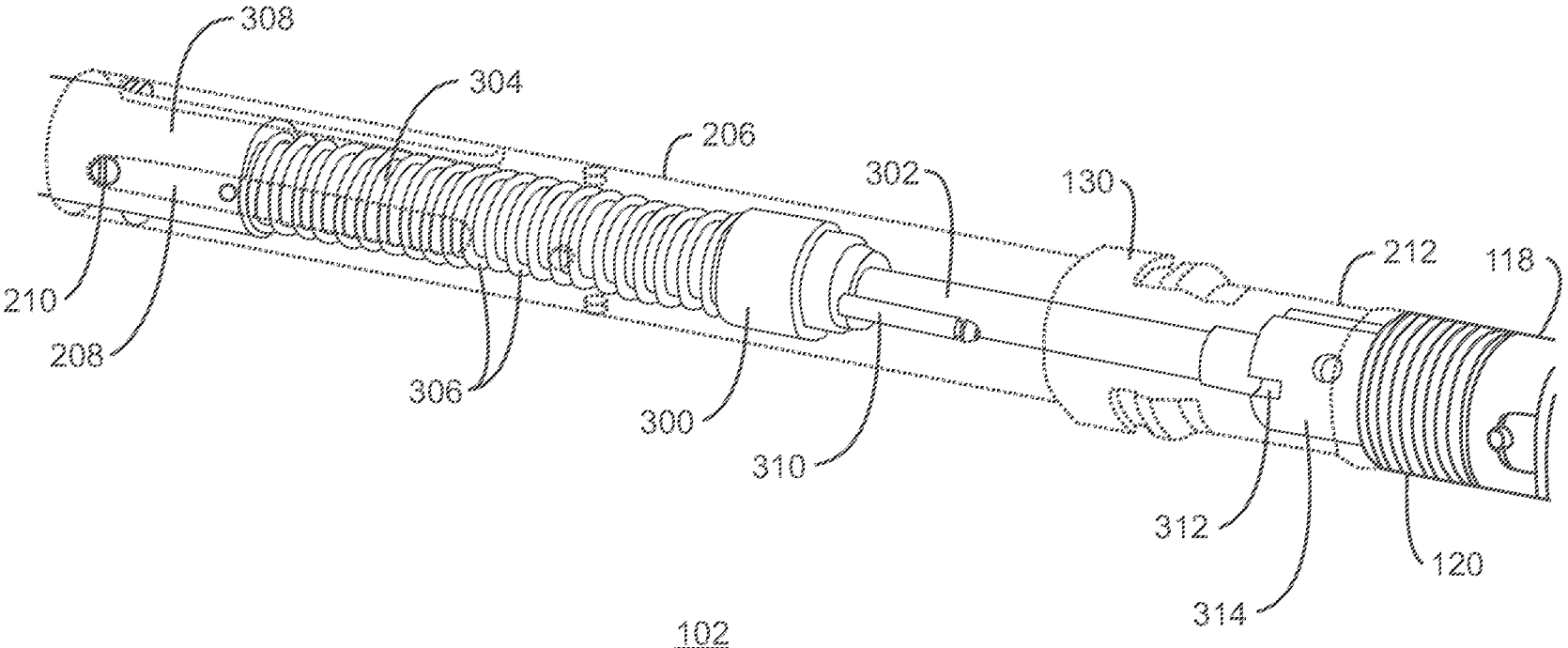
FIG. 3B is a perspective view of the exemplary embodiment of the lock mandrel showing the internal spring-loaded locking collar in the unseated position.

FIG. 3B is a perspective view of the exemplary embodiment of the lock mandrel 102 showing the internal spring-loaded locking collar 300 in the unseated position. Like numbered items are as described with respect to FIGS. 1, 2, and 3A. In various embodiments, the spring-loaded locking collar 300 moves to the unseated position in response to a force applied from the surface during removal of the tool assembly from the hydrocarbon well 100. As shown in FIG. 3B, when the spring-loaded locking collar 300 moves to the unseated position, the spring-loaded locking collar 300, the hollow outer rod 304, and the compression spring 306 retract. This allows the locking keys 130 to be released from the landing nipple 128 and, thus, allows the tool assembly to be removed from the hydrocarbon well 100 via the wireline 122.

In addition, in various embodiments, the retraction of the spring-loaded locking collar 300 causes the equalizing pins 310 to also retract and, therefore, become disengaged from the seal bores 312 on the equalizing port 314. Retraction of the equalizing pins 310 reduces the amount of force required to pull the lock mandrel 102 out of the tubing 114 by equalizing the hydrostatic pressure within the lock mandrel 102.

Furthermore, in various embodiments, retraction of the hollow outer rod 304 also causes the jarring rod 308 to retract, moving the screws 210 to an engaged position within the slots 208. Specifically, the screws 210 may bang against the opposite side of the slots 208, providing a jarring force to aid in the disengagement of the lock mandrel 102 from the landing nipple 128.

Figure 4A:
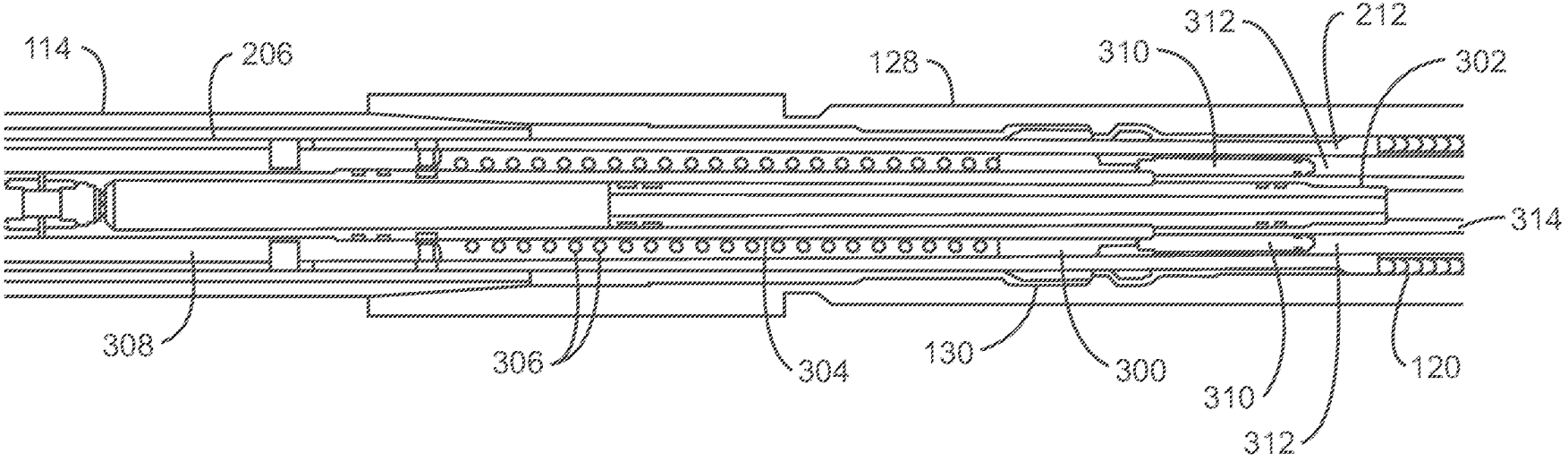
FIG. 4A is a cross-sectional schematic view of an exemplary embodiment of the lock mandrel engaged with the landing nipple inside the tubing.

FIG. 4A is a cross-sectional schematic view of an exemplary embodiment of the lock mandrel 102 engaged with the landing nipple 128 inside the tubing 114. Like numbered items are as described with respect to FIGS. 1, 2, 3A, and 3B. The cross-sectional schematic view of FIG. 4A shows the inner workings of the upper and lower connectors 206 and 212 of the lock mandrel 102. In particular, the cross-sectional schematic view of FIG. 4A shows the manner in which the internal spring-loaded locking collar 300 presses radially against the locking keys 130 from the inside and the equalizing pins 310 slide into the seal bores 312 on the equalizing port 314 when the spring-loaded locking collar 300 is in the seated position.

Figure 4B:
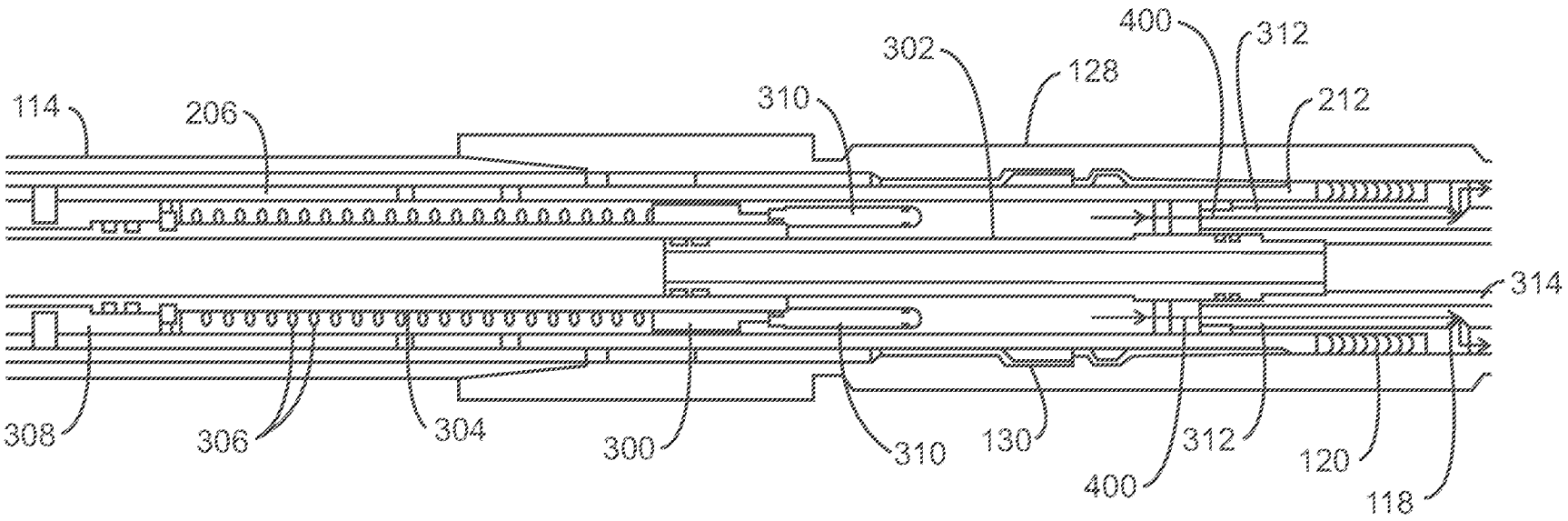
FIG. 4B is another cross-sectional schematic view of the exemplary embodiment of the lock mandrel engaged with the landing nipple inside the tubing.

FIG. 4B is another cross-sectional schematic view of the exemplary embodiment of the lock mandrel 102 engaged with the landing nipple 128 inside the tubing 114. Like numbered items are as described with respect to FIGS. 1, 2, 3A, 3B, and 4A. The cross-sectional schematic view of FIG. 4A shows the manner in which the internal spring-loaded locking collar 300 retracts away from the locking keys 130 and the equalizing pins 310 retract away from the seal bores 312 on the equalizing port 314 when the spring-loaded locking collar 300 is in the unseated position. In various embodiments, retraction of the equalizing pins 310 allows the hydrostatic pressure to equalize across the seal stack 120 on the pump adaptor 118, i.e., between the upper connector 206 and the lower connector 212 of the lock mandrel 102. The flow paths for pressure equalization are indicated by arrows 400 in FIG. 4B.

Figure 5A:
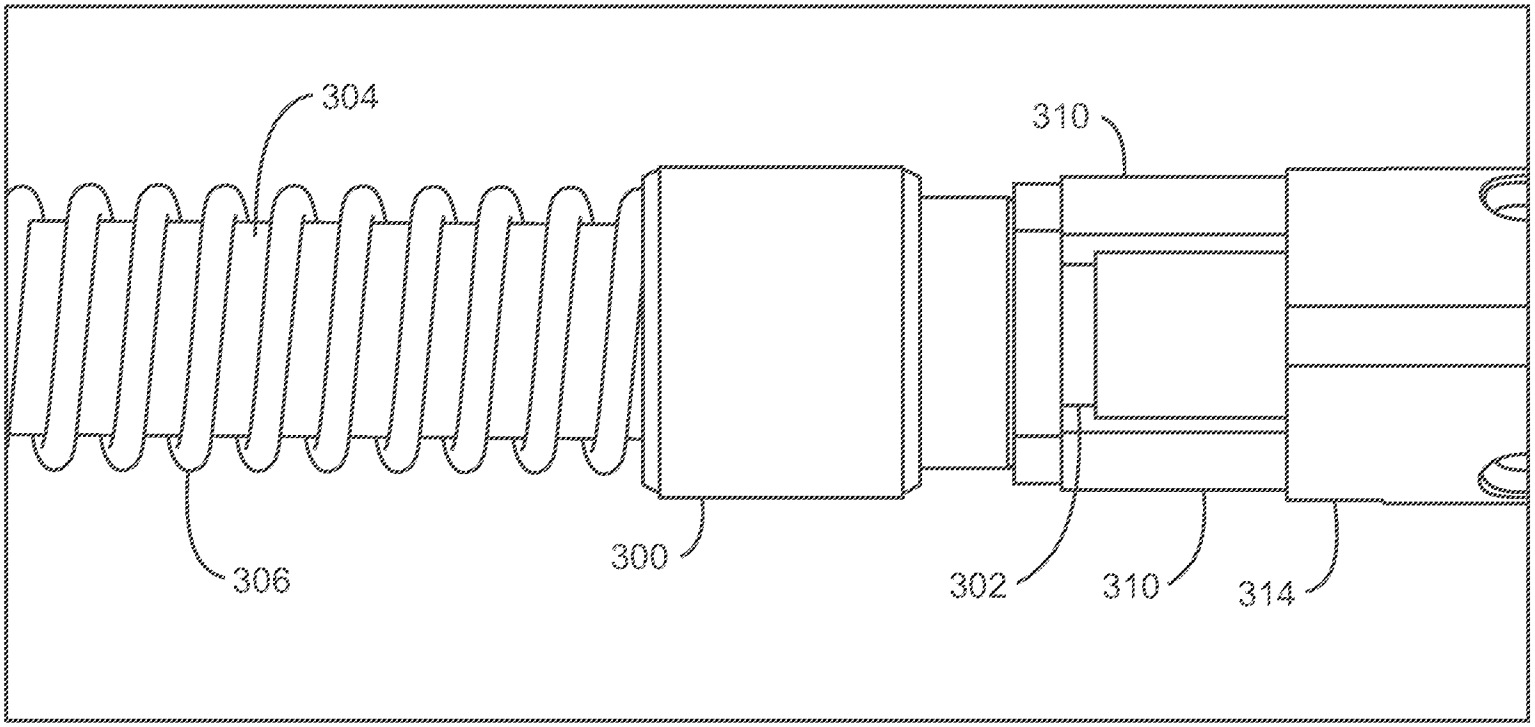
FIG. 5A is a close-up schematic view of an exemplary embodiment of the lock mandrel showing the internal spring-loaded locking collar and the equalizing pins aligned with the equalizing port on the lower connector.

FIG. 5A is a close-up schematic view of an exemplary embodiment of the lock mandrel 102 showing the internal spring-loaded locking collar 300 and the equalizing pins 310 aligned with the equalizing port 314 on the lower connector 212. Like numbered items are as described with respect to FIGS. 1, 2, 3A, 3B, 4A, and 4B. The schematic view of FIG. 5A clearly shows how the equalizing pins 310 engage with the seal bores 312 on the equalizing port 314 to provide a complete seal between the lock mandrel 102 and the landing nipple 128 within the hydrocarbon well 100.

Figure 5B:
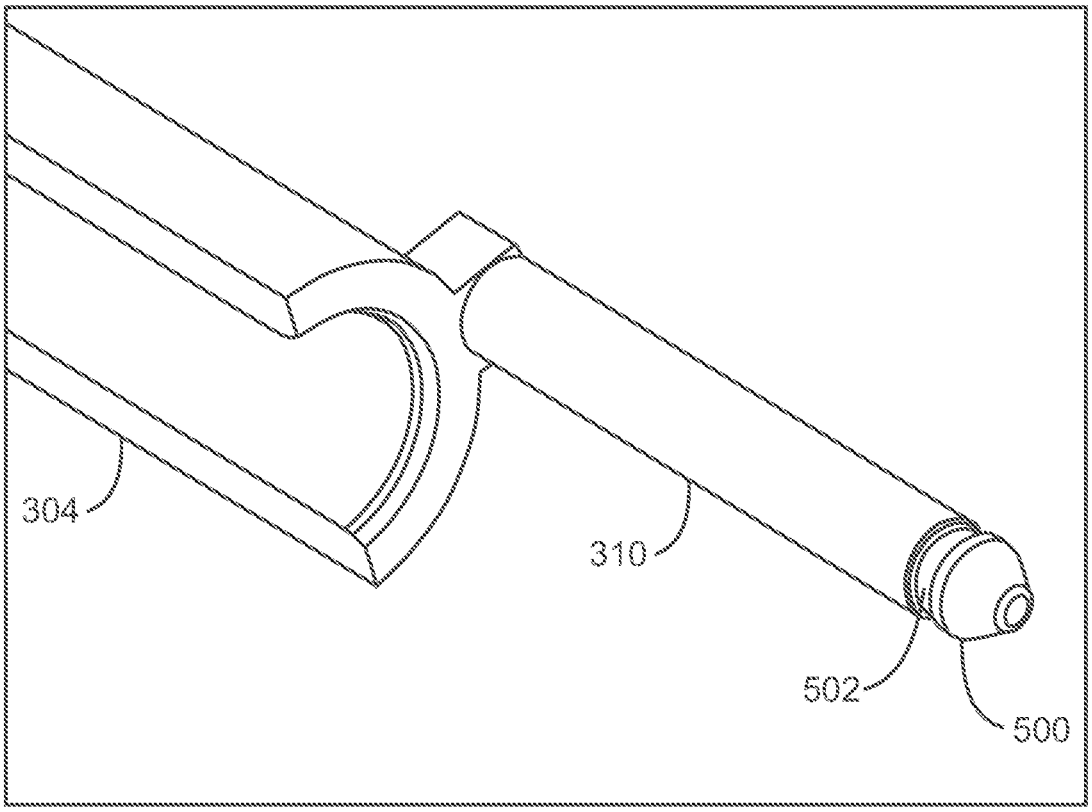
FIG. 5B is a close-up schematic view of an exemplary embodiment of one equalizing pin extending from the hollow outer rod of the upper connector.

FIG. 5B is a close-up schematic view of an exemplary embodiment of one equalizing pin 310 extending from the hollow outer rod 304 of the upper connector 206. Like numbered items are as described with respect to FIGS. 1, 2, 3A, 3B, 4A, 4B, and 5A. As shown in FIG. 5B, the equalizing pin 310 may include an alignment head 500 that provides for self-alignment of the equalizing pin 310 as it slides into the corresponding seal bore 312. In addition, the equalizing pin 310 may include a sealing ring 502 that fluidically seals the seal bore 312 when the spring-loaded locking collar 300 is in the seated position.

In various embodiments, the cross-sectional area of each equalizing pin 310 is much smaller than the cross-sectional area of the full lock mandrel 102. For example, the cross-sectional area of each equalizing pin 310 may be less than around 0.5 inches, while the cross-sectional area of the full lock mandrel 102 may be around 2.5 inches. As a result, retraction of the equalizing pins 310 significantly reduces the amount of force required to disengage the lock mandrel 102 from the landing nipple 128. For example, if the hydrostatic pressure in the hydrocarbon well 100 is around 3,000 psi, the lock mandrel 102 may be disengaged from the landing nipple 128 with a total tensile force of around 472 pounds-force (lbf). As another example, if the hydrostatic pressure in the hydrocarbon well 100 is around 6,000 psi, the lock mandrel 102 may be disengaged from the landing nipple 128 with a total tensile force of around 924 lbf.

The views of FIGS. 2, 3A, 3B, 4A, 4B, 5A, and 5B are not intended to indicate that the lock mandrel 102 is to include all of the components shown in FIGS. 2, 3A, 3B, 4A, 4B, 5A, and 5B. Moreover, the lock mandrel 102 may include any number of additional or alternative components not shown in FIGS. 2, 3A, 3B, 4A, 4B, 5A, and 5B, depending on the details of the specific implementation. For example, in some embodiments, the lock mandrel 102 does not include the cable head 200 shown in FIG. 2. In such embodiments, the tool assembly may be run into the hydrocarbon well 100 using the wireline 122, and the wireline 122 may then detach from the tool assembly, leaving the lock mandrel 102 and the attached pump 104 autonomous within the hydrocarbon well 100. The pump 104 may then use the on-board power source 124 to operate independently of the wireline 122. Moreover, when it is time to release the tool assembly from the landing nipple 128, the wireline 122 may be run back into the hydrocarbon well 100, latched onto an external fishing neck (or other similar attachment) on the lock mandrel 102, and then used to lift the tool assembly out of the hydrocarbon well 100.

Figure 6:
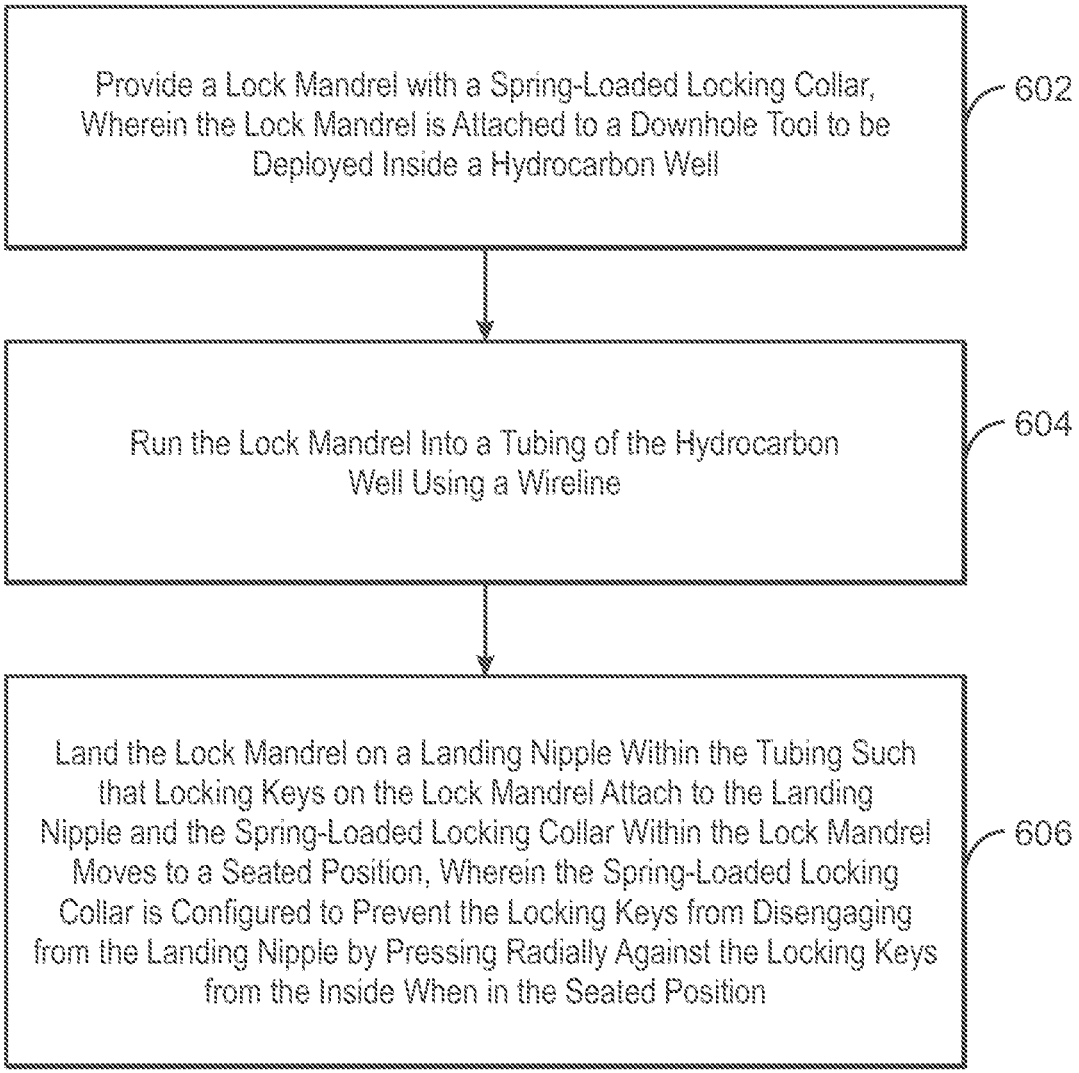
FIG. 6 is a process flow diagram of a method for securing a tool within a hydrocarbon well using a lock mandrel with a spring-loaded locking collar.

Method for Securing a Downhole Pump within a Hydrocarbon Well Using a Lock Mandrel with a Spring-Loaded Locking Collar FIG. 6 is a process flow diagram of a method 600 for securing a tool within a hydrocarbon well using a lock mandrel with a spring-loaded locking collar. In various embodiments, the lock mandrel that is utilized for the method 600 is as described with respect to any of FIGS. 1, 2, 3A, 3B, 4A, 4B, 5A, and 5B. The method 600 begins at block 602, at which a lock mandrel with a spring-loaded locking collar is provided. The lock mandrel is attached to a downhole tool, such as a downhole pump, to be deployed inside a hydrocarbon well. At block 604, the lock mandrel is run into a tubing of the hydrocarbon well using a wireline.

At block 606, the lock mandrel is landed on a landing nipple within the tubing such that locking keys on the lock mandrel attach to the landing nipple and the spring-loaded locking collar within the lock mandrel moves to a seated position. The spring-loaded locking collar is configured to prevent the locking keys from disengaging from the landing nipple by pressing radially against the locking keys from the inside when in the seated position.

The process flow diagram of FIG. 6 is not intended to indicate that the steps of the method 600 are to be executed in any particular order, or that all of the steps of the method 600 are to be included in every case. Further, any number of additional steps not shown in FIG. 6 may be included within the method 600, depending on the details of the specific implementation. For example, in various embodiments, the method 600 also includes applying a force from the surface via the wireline such that the spring-loaded locking collar moves to an unseated position, wherein the spring-loaded locking collar is configured to allow the locking keys to disengage from the landing nipple by retracting away from the locking keys when in the unseated position. In some embodiments, applying the force from the surface causes a number of slots and a number of screws within the lock mandrel to provide a jarring force that aids in detaching the lock mandrel from the landing nipple. In addition, in some embodiments, landing the lock mandrel on the landing nipple at block 606 causes a number of equalizing pins within the lock mandrel to seal a flow path through the lock mandrel, and applying the force from the surface causes the equalizing pins to unseal the flow path, allowing a hydrostatic pressure across the lock mandrel to equalize. This, in turn, reduces the amount of force required to pull the lock mandrel and the attached downhole tool out of the tubing of the hydrocarbon well. Furthermore, in embodiments in which the downhole tool is a downhole pump, the method 600 may include using the downhole pump to remove at least a portion of a wellbore liquid from the tubing of the hydrocarbon well.

While the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. A lock mandrel, comprising:

an upper connector, comprising:

locking keys configured to attach the lock mandrel to a landing nipple on a tubing within a hydrocarbon well; and a spring-loaded locking collar configured to:

prevent the locking keys from disengaging from the landing nipple by pressing radially against the locking keys from the inside when in a seated position; and allow the locking keys to disengage from the landing nipple by retracting away from the locking keys when in an unseated position; and a lower connector, comprising a tool adaptor configured to attach a downhole tool to the lock mandrel;

wherein the upper connector comprises a compression spring configured to:

prevent the spring-loaded locking collar from retracting to the unseated position in response to an increase in a pressure differential within the lock mandrel; and allow the spring-loaded locking collar to retract to the unseated position in response to a force applied from a surface.

2. The lock mandrel of claim 1, wherein the lower connector comprises a plurality of seal bores positioned on an equalizing port, and wherein the upper connector comprises a plurality of equalizing pins configured to:

engage with the plurality of seal bores on the equalizing port when the spring-loaded locking collar is in the seated position; and disengage from the plurality of seal bores when the spring-loaded locking collar is in the unseated position, equalizing a hydrostatic pressure across the lock mandrel.

3. The lock mandrel of claim 2, wherein each equalizing pin comprises:

an alignment head configured to self-align the equalizing pin as it slides into a corresponding seal bore; and a sealing ring that fluidically seals the corresponding seal bore when the equalizing pin is engaged with the corresponding seal bore.

4. The lock mandrel of claim 1, wherein the upper connector comprises a plurality of slots and a plurality of screws that are configured to provide a jarring force to aid in detaching the lock mandrel from the landing nipple when the spring-loaded locking collar is in the unseated position.

5. The lock mandrel of claim 4, wherein the plurality of slots are positioned along an outer diameter of the upper connector, and wherein the plurality of screws are attached to a jarring rod that is attached to the compression spring corresponding to the spring-loaded locking collar.

6. The lock mandrel of claim 1, wherein the downhole tool comprises a downhole pump.

7. The lock mandrel of claim 1, wherein the upper connector comprises a hollow inner rod and a hollow outer rod that is slidably positioned around the hollow inner rod, and wherein the spring-loaded locking collar and the corresponding compression spring are positioned along an outer diameter of the hollow outer rod.

8. The lock mandrel of claim 1, wherein the locking keys correspond to an X nipple profile.

9. The lock mandrel of claim 1, wherein the lock mandrel comprises an electronic chassis and an electronic chassis housing that is attached to the upper connector of the lock mandrel.

10. The lock mandrel of claim 1, wherein the lock mandrel comprises a cable head configured to attach the lock mandrel to a wireline.

11. The lock mandrel of claim 1, wherein the lock mandrel comprises an external fishing neck for attaching a wireline to the lock mandrel.

12. A method for securing a downhole tool within a hydrocarbon well using a lock mandrel with a spring-loaded locking collar, comprising:

providing the lock mandrel with the spring-loaded locking collar, wherein the lock mandrel is attached to the downhole tool to be deployed inside the hydrocarbon well;

running the lock mandrel into a tubing of the hydrocarbon well using a wireline; and landing the lock mandrel on a landing nipple within the tubing such that locking keys on the lock mandrel attach to the landing nipple and the spring-loaded locking collar within the lock mandrel moves to a seated position, wherein the spring-loaded locking collar is configured to prevent the locking keys from disengaging from the landing nipple by pressing radially against the locking keys from the inside when in the seated position;

wherein landing the lock mandrel on the landing nipple causes a plurality of equalizing pins within the lock mandrel to seal a flow path through the lock mandrel, and wherein applying the force from the surface causes the plurality of equalizing pins to unseal the flow path, allowing a hydrostatic pressure across the lock mandrel to equalize.

13. The method of claim 12, comprising:

applying a force from a surface via the wireline such that the spring-loaded locking collar moves to an unseated position, wherein the spring-loaded locking collar is configured to allow the locking keys to disengage from the landing nipple by retracting away from the locking keys when in the unseated position; and pulling the lock mandrel and the attached downhole tool out of the tubing of the hydrocarbon well.

14. The method of claim 13, wherein applying the force from the surface causes a plurality of slots and a plurality of screws within the lock mandrel to provide a jarring force that aids in detaching the lock mandrel from the landing nipple.

15. The method of claim 12, comprising operating the downhole tool within the hydrocarbon well.

16. The method of claim 15, wherein the downhole tool comprises a downhole pump, and wherein operating the downhole pump comprises using the downhole pump to remove at least a portion of a wellbore liquid from the tubing of the hydrocarbon well.

17. A tool assembly, comprising:

a lock mandrel, comprising:

an upper connector, comprising:

locking keys configured to attach the lock mandrel to a landing nipple on a tubing within a hydrocarbon well; and a spring-loaded locking collar configured to:

prevent the locking keys from disengaging from the landing nipple by pressing radially against the locking keys from the inside when in a seated position; and allow the locking keys to disengage from the landing nipple by retracting away from the locking keys when in an unseated position; and a lower connector, comprising a pump adaptor configured to attach a downhole pump to the lock mandrel; and the downhole pump configured to remove at least a portion of a wellbore liquid from the tubing of the hydrocarbon well;

wherein the lower connector comprises an equalizing port with a plurality of seal bores, and wherein the upper connector comprises a plurality of equalizing pins configured to:

engage with the plurality of seal bores on the equalizing port when the spring-loaded locking collar is in the seated position; and disengage from the plurality of seal bores when the spring-loaded locking collar is in the unseated position, equalizing a hydrostatic pressure across the lock mandrel.

18. The tool assembly of claim 17, wherein each equalizing pin comprises:

an alignment head configured to self-align the equalizing pin as it slides into a corresponding seal bore; and a sealing ring that fluidically seals the corresponding seal bore when the equalizing pin is engaged with the corresponding seal bore.

19. The tool assembly of claim 17, wherein the upper connector of the lock assembly comprises a compression spring configured to:

prevent the spring-loaded locking collar from retracting to the unseated position in response to an increase in a pressure differential within the lock mandrel; and allow the spring-loaded locking collar to retract to the unseated position in response to a force applied from a surface.

20. The tool assembly of claim 17, wherein the upper connector of the lock assembly also comprises a plurality of slots and a plurality of screws that are configured to provide a jarring force to aid in detaching the lock mandrel from the landing nipple when the spring-loaded locking collar is in the unseated position.

21. The tool assembly of claim 20, wherein the plurality of slots are positioned along an outer diameter of the upper connector, and wherein the plurality of screws are attached to a jarring rod that is attached to a compression spring corresponding to the spring-loaded locking collar.

22. The tool assembly of claim 17, wherein the upper connector of the lock mandrel comprises a hollow inner rod and a hollow outer rod that is slidably positioned around the hollow inner rod, and wherein the spring-loaded locking collar and a corresponding compression spring are positioned along an outer diameter of the hollow outer rod.

* * * * *